United States Patent [19]

Tsai

[11] Patent Number: 4,959,124

[45] Date of Patent: Sep. 25, 1990

[54] METHOD OF BLEACHING KRAFT PULP IN A DZED SEQUENCE

[75] Inventor: Ted Y. Tsai, Harriman, N.Y.

[73] Assignee: International Paper Company, Tuxedo, N.Y.

[21] Appl. No.: 348,606

[22] Filed: May 5, 1989

[51] Int. Cl.[5] ..... D21C 9/14; D21C 9/153

[52] U.S. Cl. ..... 162/65; 162/67; 162/89

[58] Field of Search ..... 162/65, 87, 88, 89, 162/67

[56] References Cited

U.S. PATENT DOCUMENTS

| | | | |
|---|---|---|---|
| 396,325 | 1/1889 | Brin . | |
| 1,957,937 | 5/1934 | Campbell et al. | 8/2 |
| 4,216,054 | 8/1980 | Bentvelzen et al. | 162/57 |
| 4,229,252 | 10/1980 | Meredith | 162/65 |
| 4,259,149 | 3/1981 | Jaszka et al. | 162/29 |
| 4,451,567 | 5/1984 | Ishibashi | 435/170 |
| 4,543,155 | 9/1985 | Stawicki | 162/57 |
| 4,622,101 | 11/1986 | Hull et al. | 162/65 |

OTHER PUBLICATIONS

Granum et al, "Influence of Bleaching Chemicals and Sequences on Some Properties of Sulphite Pulps"; *Journal of Pulp & Paper Science*; Mar. 1984, pp. J25–J29.

"Technical News", PT Dec./Jan. 1989, p. 36.

Lachenal, D. and Bokstrom, M. (1986), Improvement of Ozone Prebleaching of Kraft Pulps, Journal of Pulp and Paper Science, 12(2):J50.

Germgard, U. and Sjogren, B. (1985) Ozone Prebleaching of Modified-Cooked and Oxygen-Bleached Softwood Kraft Pulp, Svensk Pappers, 15:R127.

Liebergott et al (1984), Bleaching a Softwood Kraft Pulp Without Chlorine Compunds, TAPPI 67(8):76.

*Primary Examiner*—Steve Alvo

*Attorney, Agent, or Firm*—Luedeka, Hodges & Neely

[57] ABSTRACT

A method of enhancing the quality of a pulp which has been subjected to a chlorine-based bleaching agent, by subjecting the chlorinated pulp to ozonation prior to an extraction stage in the bleaching sequence. The improved pulp of the present invention includes reduction of total organically bound chlorine residues in the wood pulp and adsorbed organic halides (AOX) in the effluent, and has good brightness and viscosity. The advantages of the present invention may be accomplished by means of a bleaching sequence that employs as few as four stages, namely DZED with attendant relatively lower capital investment than heretofore possible.

6 Claims, 5 Drawing Sheets

METHOD OF BLEACHING KRAFT PULP IN A DZED SEQUENCE

FIELD OF THE INVENTION

The present invention relates to delignification and bleaching of cellulosic wood pulp fibers for use in papermaking and to the production of a pulp having reduced halogen concentrations, and good brightness and viscosity.

BACKGROUND OF THE INVENTION

Chlorine-based chemicals, such as chlorine, chlorine dioxide, and hypochlorite, have been used in pulp bleaching for several decades, and continue to be used for removing lignin and bleaching the pulp to high brightness. In general terms, the extent of bleaching, hence the degree of brightness obtained, is determined by the type of pulp being bleached and the proposed end use of the paper product. For example, kraft pulps intended for use in making fine writing papers require different bleaching circumstances which will produce the desired brightness in the final paper product. In all instances, however, where chlorine-based bleaching agents have been employed in the prior art, there are produced chlorinated organics. These compounds are generally insoluble and substantial quantities are swept from the pulp with the effluent from one or more of the stages of the bleaching sequence. A relatively smaller percentage of such chlorinated organics remain in the pulp and eventually appear in the paper product.

In chlorine-based bleaching processes, the "C" factor of the pulp is employed as a measure of the chlorination charge required for a specific pulp. By definition, the "C" factor refers to the effective chlorination charge and is equal to the chlorine dioxide plus the chlorine in the charge (expressed in terms of effective chlorine), divided by the Kappa number of the pulp. Generally, it is stated in the prior art that higher "C" factors produce brighter pulps, but that a "C" factor 0.22 provides maximum brightness in a pulp without unacceptable degradation of the cellulosic fibers (e.g. reduced strength). Thus, it has been common heretofore when seeking maximum brightness of the pulp, (in the range of 70–85% GE) to use large "C" factors, i.e. larger quantities of chlorine-containing bleaching agent.

In the past decade, there has been a growing concern about the environmental impact of chlorinated organic compounds in bleach plant effluent. Also, public concern for the disposal of paper containing organically bound chloride has been increasing. Undesirable chlorinated organics such as dioxin have been detected in the exhaust gases of incinerators burning municipal wastes containing chloride, including, for example, paper products made from chlorine bleached pulps. West German environmental regulations, for example, propose restricting the total chloride residue for packaging material including wood pulp to less than 200 ppm. The allowable adsorbed organic halogens (AOX) discharged in the effluent per ton of wood pulp has been restricted to 2.0 kg or less. More stringent regulations are expected in the near future.

Several options have been proposed or practiced to reduce or eliminate chlorinated organics in the bleaching process. The most straightforward method is to substitute non-chlorine bleaching chemicals, such as oxygen, peroxides, ozone, peracetic acid, etc. for chlorine-based bleaching chemicals. Unfortunately, no chlorine-free bleaching process has been developed with the ability to produce acceptable pulp properties (such as brightness or viscosity) at an acceptable bleaching cost.

Another option to reduce the discharge of chlorinated organic compounds is to reduce the chlorine usage in the first stage of the bleaching process. Two alternatives that produce no significant degradation of pulp properties have been commercialized for this purpose. These are (a) extended delignification in the cooking stage and (b) oxygen delignification. These alternatives, with proper extraction, reduce the lignin content of brown stock going into the bleach plant. They do not, however, reduce the chlorinated organic compounds in the bleached pulp and effluent to sufficiently low levels.

A third option to reduce the generation of chlorinated organics in a bleaching process is to substitute chlorine dioxide for chlorine. Chlorine dioxide is a relatively strong oxidant compared to chlorine; to achieve the same degree of delignification, it requires only about thirty-eight weight percent chlorine dioxide on the pulp compared with one hundred weight percent of chlorine. However, these prior art processes are of the DEDED type wherein the chlorination stage (D) is followed by the conventional extraction (E) and additional chlorination (D) stages. The pulp and the discharge effluents resulting from this prior art option contain higher concentrations of chlorinated organics than are acceptable and/or desirable. Processes using both oxygen delignification and chlorine dioxide substitution have been suggested but do not achieve the regulated concentrations of chlorine-containing residues in either the pulp or the effluent.

SUMMARY OF THE INVENTION

In accordance with the method of the present invention, a cellulosic wood pulp is initially contacted with a chlorine-based bleaching agent as the first-stage of a bleaching sequence. This chlorination agent preferably is primarily chlorine dioxide, but may contain chlorine. Contrary to the prior art, after this initial D stage and prior to any extraction (E) stage, the pulp is processed through an ozonation stage. After the ozonation stage, the pulp is processed through the customary extraction, further bleaching, etc. stages. Importantly, and as noted to be contrary to the prior art, the ozonation takes place immediately following chlorination and prior to extraction. It has been recognized heretofore that ozone as a strong oxidant tends to degrade the pulp and that any use of ozone on pulp should be preceded with an acid wash, for example to remove heavy metals known to be harmful to the stability of ozone and/or decomposition products that may cause low pulp properties (e.g. strength). Contrary to such prior art, the present inventor has found that without an acid wash stage the ozonation can take place immediately following an initial chlorine dioxide (D) bleaching stage. In this regard, it is to be understood that preferably there is a conventional water washing of the pulp between the stages of the bleaching sequence. This washing is not deemed to be a "stage", but rather is in the nature of a dilution of the aqueous phase of the pulp. For example, the quantity of water commonly used provides a dilution factor of between about 1 and about 3. It has been found that the wash water need not be "clean" or "fresh" water. For example, recirculated water which contains considerable residues from previous usage has been used successfully.

Among the several unexpected advantages provided by the present method, it has been found that the ozone treatment not only provides delignification and bleaching but also oxidizes substantial quantities of the chlorinated lignin residues left over from the chlorination stage. This oxidative activity converts substantial quantities of the insoluble chlorinated organics to inorganic chlorine-containing compounds and/or to chlorinated organics that are soluble in the liquor present in the ozonation stage. The oxidation of these chlorinated residues by the ozone thus not only reduces the chlorinated organic content in the wood pulp, but also reduces the adsorbed chlorinated organics discharged in the effluent. These converted inorganic chlorides, generally, are not environmentally hazardous. The result is a pulp having good brightness, acceptable viscosity, and reduced chlorinated organic content. Notably, such desirable results are obtained by employing as few as four stages in the bleaching sequence, and employing lower total effective chlorine charges in the chlorination stage than heretofore known to be possible.

Specifically, the present inventors, using their improved method, have produced wood pulp which has less than 200 ppm total organic chloride (TOCl) residue. TOCl as used herein refers to the total organically bound chlorine content of the pulp resulting from the bleaching sequence unless indicated otherwise. TOCl is essentially insoluble. The effluent discharge from the bleaching process of the disclosed method has less than 2.0 kg adsorbed organic halides (AOX) per ton of wood pulp. AOX, as the term is used herein refers to the sum of the AOX, i.e. adsorbed organic halides, of the several stages of bleaching, i.e. AOX of the $D_1$ stage plus AOX of the Z stage plus AOX of the E stage and plus AOX of the $D_2$ stage, unless indicated otherwise. As noted, the pulp produced by the present invention has a brightness and viscosity that meet or exceed the requirements of industrial papermaking.

Therefore, it is an object of the present invention to provide a method for the preparation of cellulosic wood pulp fibers for use in papermaking that can provide wood pulps with lowered residual chlorine content and effluents with lowered levels of adsorbed organic halides (AOX) while retaining or enhancing the characteristics of brightness and pulp viscosity within acceptable ranges.

It is another object of the present invention to provide such an improved method for bleaching cellulosic pulp that is both economical and readily adaptable to the current papermaking industry. These and other objects will be recognized from the present description including the Figures.

Figure 1:
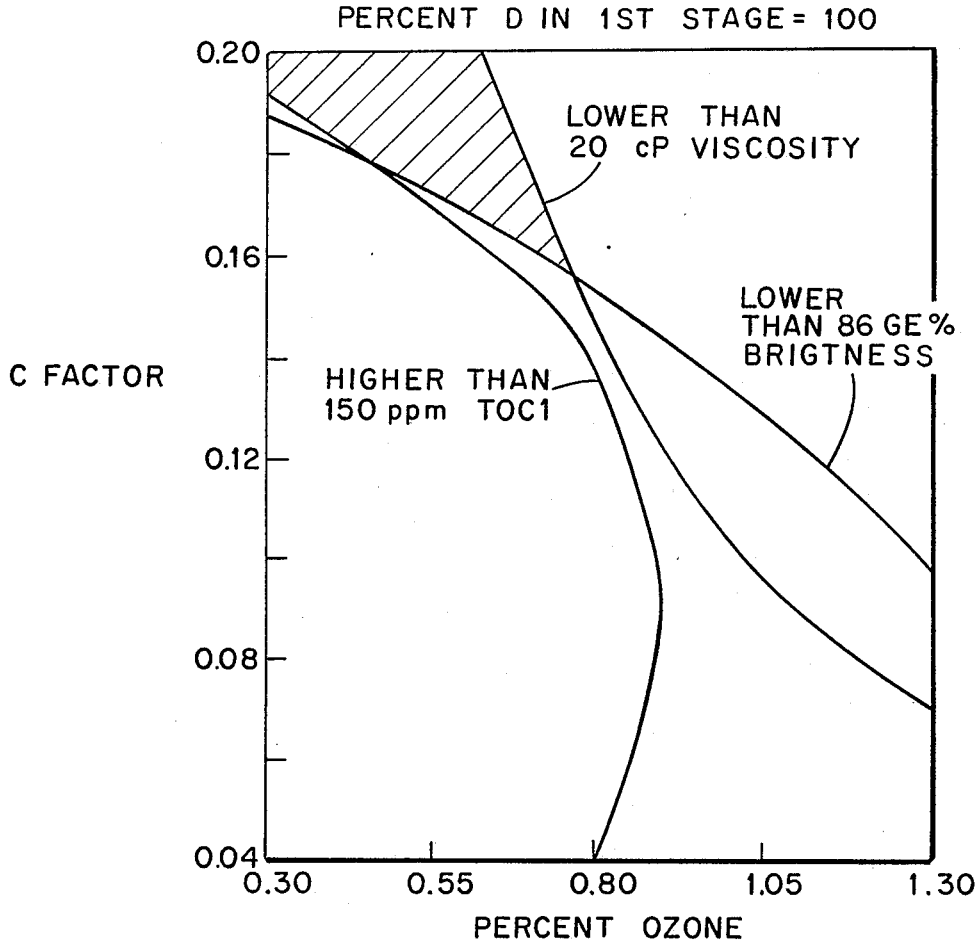
FIGS. 1-5 are graphic representations, computer-generated from mathematical models depicting the relationship of ozone charge and chlorination factor in obtaining various values of the brightness, viscosity and total chloride on pulp.
Figure 2:
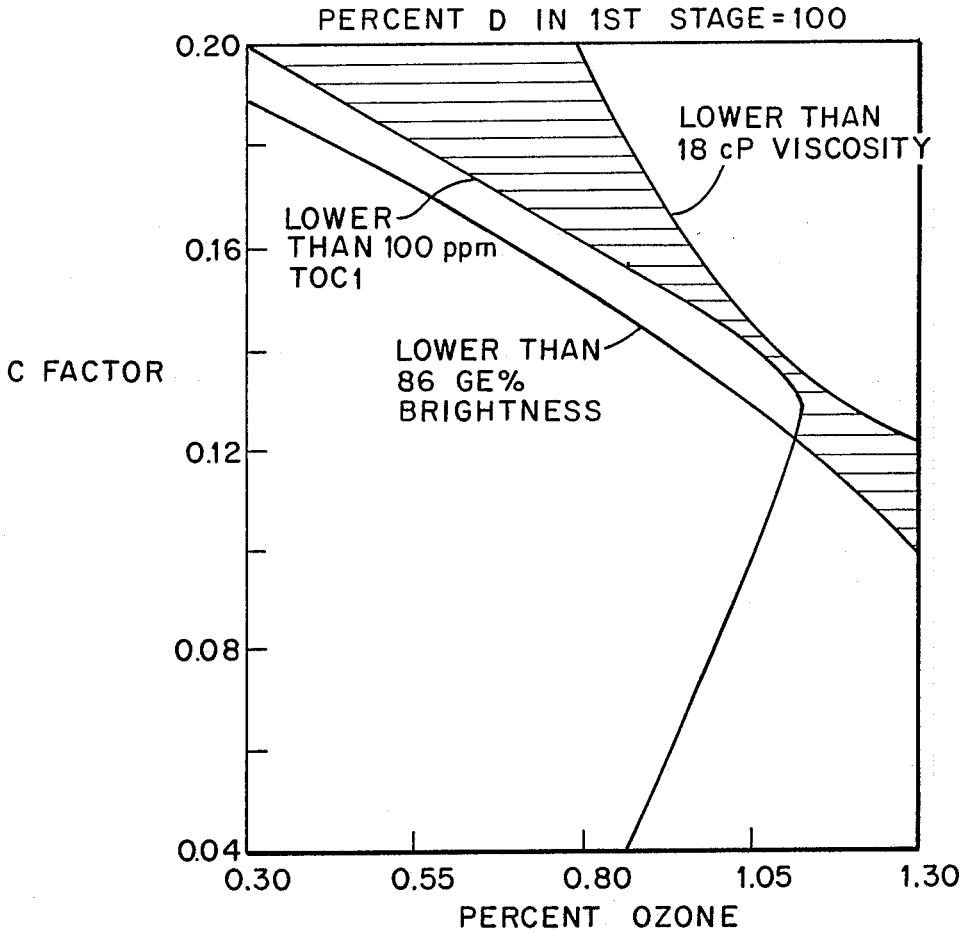
Figure 3:
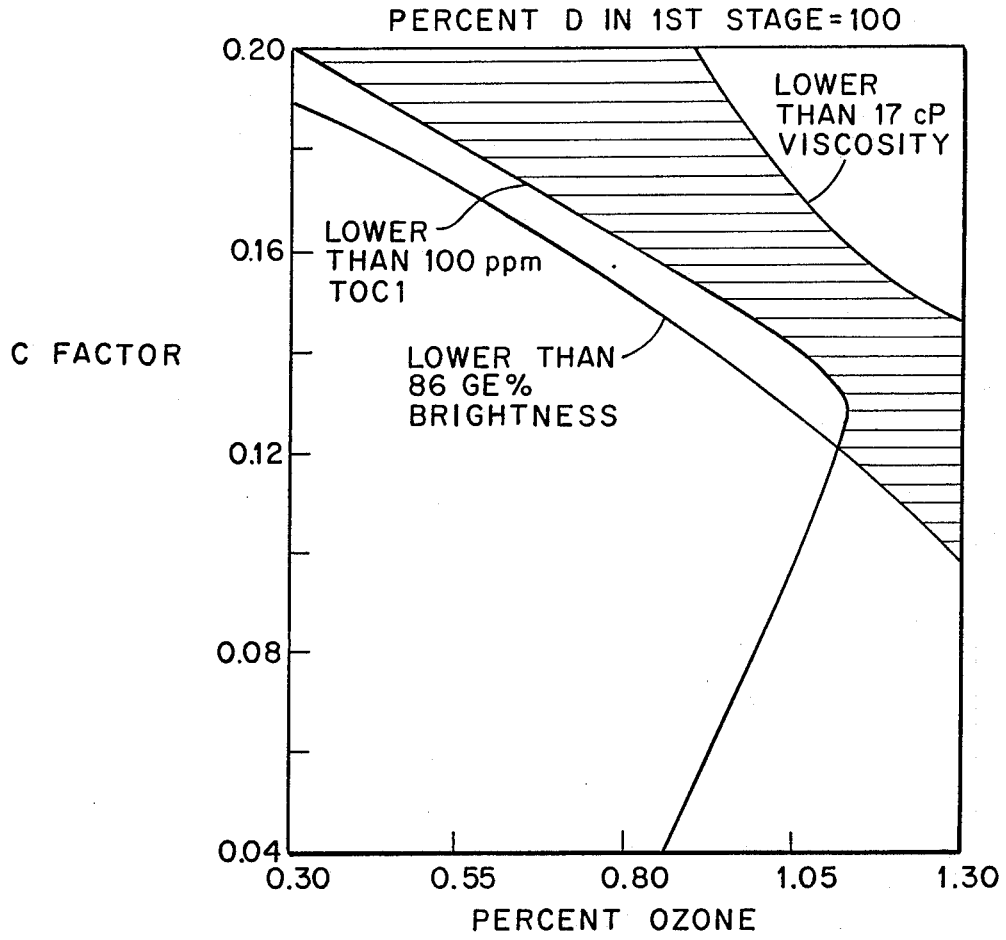

In accordance with the present invention, an aqueous slurry of cellulosic wood fibers as is commonly produced by conventional digestion means in the papermaking industry is processed through sequential stages of a bleaching operation. Softwoods, hardwoods or mixtures thereof may be processed employing the present invention. Following digestion, the slurry preferably is processed directly to the bleaching sequence disclosed herein. If desired, it may be subjected to such treatment as oxygenation, ozonation or other oxidation prior to entering the present sequence, but with attendant increased expense.

In the first stage of the present sequence, the pulp slurry is treated with a chlorine-based agent, i.e. chlorine dioxide or a mixture of chlorine dioxide and chlorine. Preferably in this stage the oxidant is principally chlorine dioxide. Consistent with the industry practices, the term, D, is employed to represent a bleaching stage employing chlorine dioxide, with $D_1$, representing the first D stage of a sequence. The term $D_c$, represents a stage employing chlorine dioxide plus chlorine.

Following the $D_1$ stage, and with or without an intervening washing, the pulp is processed through an ozonation stage, Z. Heretofore, it has been taught in the industry that ozone tends to be decomposed by certain of the non-cellulosic components of the pulp. Contrary to the prior art, in the present invention the pulp moves from the $D_1$ stage directly to the Z stage without an intervening extraction, E, stage. In the Z stage, the pulp is contacted with ozone in a reaction tower, for example, for a period of time and employing sufficient ozone to effect oxidation of substantial quantities of the chlorinated lignins and/or other chlorinated components of the pulp, in addition to the contribution of the ozone toward further delignification. Many of the oxidized chlorine-based lignins, residues, etc. commonly are soluble in the environment of the Z stage. Other of the oxidized compounds are soluble in an alkaline solution such as is present in an E stage. Thus, these oxidized chlorine-based compounds are solubilized into the liquor and extracted from the pulp during washing and/or extraction following the Z stage. This liquor effluent may then be processed as necessary to recover desirable chlorine-containing compounds or to destroy or render harmless other of the compounds. The pulp may be further processed through any of several selected stages, and preferably a complete sequence will include an extraction stage following the ozonation stage. Such extraction stage may be enhanced with oxygen, $E_o$, or peroxide, $E_p$, a combination of oxygen and peroxide, $E_{o+p}$, or other enhancer. The extraction stage is followed by a further bleaching stage, preferably using chlorine dioxide. As desired, washes may be employed between selected stages, e.g. between the E and $D_2$ stages.

To facilitate a further understanding of the invention, the following examples are given primarily for purposes of illustrating certain more specific details thereof.

Southern softwood kraft pulp with Kappa number of 32.3 and an initial viscosity of 30.3 cP was used as the wood pulp slurry for all of the following Examples except as otherwise noted. The series of Examples used various combinations of the following bleaching stages:

O stage: Prechlorination oxygen delignification was conducted in a reactor for 1 hr. at 85° C., with 3% sodium hydroxide, 40-80 psig oxygen pressure and 0.5% magnesium sulfate on the pulp at a consistency of 10%.

$D_c$ or D→C stage: In the sequential chlorine dioxide substitution stage, chlorine dioxide was added to the pulp and mixed; after 20 seconds, chlorine was added and the pulp was well mixed; this stage was conducted in a reactor for 40 min. at 50° C. with a consistency of 3-10%; except in those instances where the chlorine was present in the chlorine dioxide, in which case the chlorine was introduced simultaneously with the chlorine dioxide.

C stage: Chlorination was conducted in a reactor for 30 to 40 min. at 45° C. with a consistency of 3%, with chlorine of the desired charge.

D stage: Chlorine dioxide addition was conducted at 50° to 70° C. with a consistency of 10%;

Z stage: The ozone stage was conducted under a pH of about 2–5 at room temperature for 40 to 90 min. with a consistency of 1%;

E stage: Extraction was conducted for 60 min. at 70° C with a consistency of 10% and with desired sodium hydroxide charge;

$E_o$ stage: Extraction enhanced with oxygen was conducted under conditions similar to the E stage with an initial oxygen pressure of 40–50 psig that was gradually reduced to 0 psig;

$E_p$ stage: Extraction enhanced with peroxide was conducted under conditions similar to the E stage with a 0.4–0.6% hydrogen peroxide charge;

$E_{o+p}$ stage: Extraction enhanced with oxygen and peroxide was conducted under conditions similar to the $E_o$ stage with a 0.4% to 0.6% hydrogen peroxide charge;

Washings: The slurry was washed with distilled water in a screen box or funnel between each stage; the stage labeled (DZ) is a D stage followed immediately by a Z stage without intermediate washing.

EXAMPLES 1–5

Several prior art bleaching sequences employing procedures well known in the art were run on Southern pine softwood kraft pulp having a Kappa number of 32.3. These sequences employed the usual chlorine stages with and without chlorine dioxide substitution. The results are shown in Table I. As expected, good brightness and viscosity values were noted, except when an oxygenation stage was employed prior to chlorination (Example 3). This latter Example showed the deterioration of the pulp (low viscosity) that has been noted in the prior art. Of these Examples, only the D→C $E_{o+p}$DED produced significant reduction in the total chloride on the pulp, but such reduction was obtained only at the expense of two additional stages.

TABLE 1

| Example | Bleaching Sequence | Chemical Charge (% on Oven Dried (OD) Pulp) | | | | | Total Chloride on Pulp (ppm)* | Organic Chloride on Pulp (ppm) | Pulp Brightness (GE %) | Pulp Viscosity (cP) | C Factor |
|---|---|---|---|---|---|---|---|---|---|---|---|
| 1 | D → $CE_{o+p}$D | D → C | $E_{o+p}$ | D | | | 220 | 190 | 86.1 (83.3)** | 22.5 | 0.22 |
| | | 1.66–2.9 | 3 | 0.8 | | | | | | | |
| 2 | D → $CE_{o+p}$DED | D → C | $E_{o+p}$ | D | E | D | 195 | 150 | 88.5 (86.5) | 20.8 | 0.22 |
| | | 1.66–2.9 | 3 | 0.8 | 0.4 | 0.3 | | | | | |
| 3 | OD → $CE_{o+p}$D*** | D → C | $E_{o+p}$ | D | | | 2.15 | 170 | 86.8 (84.8) | 14.3 | 0.22 |
| | | 1.15–2 | 3 | 0.7 | | | | | | | |
| 4 | $CE_o$D | C | $E_o$ | D | | | 314 | 300 | 84.7 (80.3) | 23.8 | 0.22 |
| | | 7.25 | 4.35 | 0.7 | | | | | | | |
| 5 | CEDED | C | E | D | E | D | 345* | 320 | 86.7 (83.0) | 27.0 | 0.22 |
| | | 7.25 | 4 | 0.7 | 0.5 | 0.5 | | | | | |

Remarks:
*Estimated by the sum of inorganic and organic chlorides
**Reverted brightness (at 105° C. for 1 hr).
***Oxygen pulp with kappa number = 22.3, viscosity = 21.8 cP

EXAMPLES 6–13

In Examples 6–13 the pulp employed was the same as in Examples 1–5. Examples 6–13 involved bleaching sequences using an ozone bleaching stage. Table 2 shows the properties of the pulps of these Examples. Employing ozonation prior to chlorination, Examples 6, 7, 10 and 12, produced pulps of low brightness, except in Examples 7 and 12 where additional and costly extraction and chlorination stages were added. Quite unexpectedly, Examples 8 and 9 (DZED) where ozonation was employed after chlorination, produced pulps of good brightness and viscosity plus low total chloride on the pulp. Notably, Examples 8 and 9 (DZED) employed 20% and 7% less chlorine dioxide than Example 11 (DZEDED) plus the fact that the DZED sequence with its fewer stages yielded better viscosity values and almost equal brightness values. Further, the brightness obtained by the DZED sequence is almost equal to the brightness obtained in the more costly prior art CEDED sequence (cf. Ex. 10 and Ex. 5).

TABLE 2

| Example | Bleaching Sequence | Chemical Charge (% on Oven Dried (OD) Pulp) | | | | | | Total Chloride on Pulp (ppm) | Organic Chloride on Pulp (ppm) | Pulp Brightness (GE %) | Pulp Viscosity (cP) | C Factor |
|---|---|---|---|---|---|---|---|---|---|---|---|---|
| 6 | ZED | Z | E | D | | | | ND(1) | ND | 78.9 (N.D.)** | 16.5 | 0 |
| | | 2 | 2.5 | 1.5 | | | | | | | | |
| 7 | ZEDED | Z | E | D | E | D | | 75* | 57 | 87.9 (85.2) | 14.4 | 0 |
| | | 2 | 2.5 | 1.5 | 0.5 | 0.5 | | | | | | |
| 8 | DZED | D | Z | E | D | | | ND | ND | 84.7 (N.D.) | 19.0 | 0.11 |
| | | 1.37 | 1.0 | 2.5 | 0.7 | | | | | | | |
| 9 | DZED | D | Z | E | D | | | 101* | 80 | 86.5 (82.7) | 16.8 | 0.11 |
| | | 1.4 | 1.0 | 2.5 | 1.0 | | | | | | | |
| 10 | ZDED | Z | D | E | D | | | ND | ND | 79.0 (N.D.) | 23.5 | 0.11 |
| | | 1.0 | 1.37 | 2.5 | 0.7 | | | | | | | |
| 11 | DZEDED | D | Z | E | D | E | D | 77* | 65 | 89.0 (85.3) | 15.8 | 0.11 |
| | | 1.37 | 1.0 | 2.5 | 0.7 | 0.5 | 0.5 | | | | | |
| 12 | ZDEDED | Z | D | E | D | E | D | 150* | 140 | 87.2 (84.2) | 21.8 | 0.11 |

TABLE 2-continued

| Example | Bleaching Sequence | Chemical Charge (% on Oven Dried (OD) Pulp) | | | | | | Total Chloride on Pulp (ppm) | Organic Chloride on Pulp (ppm) | Pulp Brightness (GE %) | Pulp Viscosity (cP) | C Factor |
|---|---|---|---|---|---|---|---|---|---|---|---|---|
| 13 | ODZED | 1.0 | 1.37 | 2.5 | 0.7 | 0.5 | 0.5 | 99 | 70 | 86.6 (84.0) | 14.4 | 0.14 |
| | | D | Z | E | D | | | | | | | |
| | | 1.2 | 0.5 | 2.0 | 0.7 | | | | | | | |

(1)N.D.: not determined.
(2)Kappa NO. of 32.3.
*Estimated by the sum of inorganic and organic chlorides.
**Reverted brightness.

EXAMPLES 14–19

Examples 14–16 employed Southern softwood kraft pulp having a Kappa number of 27.3. Table 3 shows certain properties of the resultant bleached pulps. From Table 3 it is noted that enhancement of the extraction stage (e.g. $E_{o,p}$, or $E_{o+p}$ in the preferred DZED bleaching sequence permits the use of less chlorine dioxide in the D stage and produces a pulp of substantially equivalent brightness and viscosity to the pulp produced using a DZED sequence without such enhancement.

Examples 17–19 employed Southern hardwood kraft pulp having a Kappa of 14.9. Table 3 also shows the properties of the resultant bleached pulps of these examples. These pulps showed high viscosity and good brightness values as well as relatively low TOCl values employing total chlorine dioxide amounts less than the total chlorine dioxide amounts employed in obtaining substantially equivalent brightness and viscosity values for softwood pulp. For either softwood or hardwood pulps, the total chlorine dioxide employed in these Examples 14–19 is substantially less than the total chlorine dioxide employed to obtain equivalent brightness and viscosity values without employing ozone after chlorination.

EXAMPLES 20–54

A laboratory $D_cZED$ bleaching sequence was studied using a central composite statistically designed experiment which varied $D_c$ stage chlorination factor and fraction of chlorine dioxide charge, and ozone charge in the Z stage. The pulp had a Kappa number of 32.3. The results are shown in Table 4. In Table 4, Examples 24, 29–32, 34, 38–41, 45, 47–49 and 54 represent actual run data which served as the basis for the statistically designed experimental data of the remaining examples. From this data it may be concluded that to obtain a pulp brightness of about 85% GE or higher and a viscosity of at least about 18 cP, the preferred chlorination factor is about 0.12 and the ozone charge is about 1.1%. This holds true for chlorine dioxide which includes up to about 20% chlorine. All of the pulps of Examples 20–38 showed low TOCl and AOX values, each being within present regulatory limits. Most surprisingly, however, it was found that by using a lower chlorination factor (e.g. 0.12) which results in substantial savings in the cost of chlorine-based bleaching agent, one can use ozone percentages of about 1% and obtain a three-fold reduction in AOX values.

TABLE 3

| Example | Bleaching Sequence | Pulp Kappa No. | C Factor | % Chemical on Pulp | | | | Organic Chloride On Pulp (ppm) | Brightness (% G.E.) | Viscosity (cP) |
|---|---|---|---|---|---|---|---|---|---|---|
| 14 | $DZE_pD$ | 27.3 | 0.12 | D | Z | Ep | D | 110 | 86.3 (ND) | 16.2 |
| | | | | 1.24 | 0.6 | 3% NaOH 0.5% $H_2O_2$ | 0.5 | | | |
| 15 | $DZE_oD$ | 27.3 | 0.12 | D | Z | $E_o$ | D | 140 | 86.0 (ND) | 16.2 |
| | | | | 1.24 | 0.6 | 3 | 0.5 | | | |
| 16 | $DZE_{o+p}D$ | 27.3 | 0.12 | D | Z | $E_{o+p}$ | D | 110 | 87.0 (ND) | 14.7 |
| | | | | 1.24 | 0.6 | 3% $N_aOH$ 0.5% $H_2O_2$ | 0.5 | | | |
| 17 | $DZE_oD$ | 14.9 | 0.12 | D | Z | $E_o$ | D | 120 | 85.0 (82.1) | 18.6 |
| | | | | 0.7 | 0.4 | 1.5 | 0.6 | | | |
| 18 | $DZE_pD$ | 14.9 | 0.12 | D | Z | $E_p$ | D | 130 | 85.8 (81.7) | 18.8 |
| | | | | 0.7 | 0.4 | 1.5 | 0.6 | | | |
| 19 | $DZE_{o+p}D^{(2)}$ | 14.9 | 0.12 | D | Z | $E_{o+p}$ | D | 120 | 86.5 (82.1) | 18.6 |
| | | | | 0.7 | 0.4 | 1.5 | 0.6 | | | |

TABLE 4

| Example | Bleaching Sequence | C Factor | $C10_2$ (%) | % Charge (as effective chlorine) (% on oven dried (OD) pulp) D | C | Z | $D^3$ | Total Organic Cl on pulp (ppm) | AOX Total (kg/BDT) | Pulp Brightness (% GE) | Viscosity (cP) |
|---|---|---|---|---|---|---|---|---|---|---|---|
| 20 | DZED | 0.037 | 100 | 1.20 | 0.00 | 0.9 | 1.0 | 60 | 0.1 | 55.0 | 23.5 |
| 21 | $D_cZED$ | | 95 | 1.14 | 0.06 | 1.0 | 1.0 | 40 | 0.1 | 58.0 | 22.2 |
| 22 | $D_cZED$ | | 90 | 1.08 | 0.12 | 1.0 | 1.0 | 65 | 0.1 | 59.0 | 22.0 |
| 23 | $D_cZED$ | | 80 | 0.96 | 0.24 | 1.1 | 1.0 | 50 | 0.2 | 62.0 | 21.0 |
| 24 | $D_cZED$ | | 50 | 0.60 | 0.60 | 0.8 | 1.0 | 360 | 0.49 | 47.0 | 21.8 |
| 25 | DZED | 0.07 | 100 | 2.26 | 0.00 | 1.2 | 1.0 | 20 | 0.2 | 76.0 | 20.2 |
| 26 | $D_cZED$ | | 95 | 2.14 | 0.12 | 1.3 | 1.0 | 20 | 0.2 | 80.0 | 20.0 |

TABLE 4-continued

| Example | Bleaching Sequence | C Factor | $ClO_2$ (%) | % Charge (as effective chlorine) (% on oven dried (OD) pulp) D | C | Z | D[3] | Total Organic Cl on pulp (ppm) | AOX Total (kg/BDT) | Pulp Brightness (% GE) | Viscosity (cP) |
|---|---|---|---|---|---|---|---|---|---|---|---|
| 27 | $D_cZED$ | | 90 | 2.03 | 0.23 | 1.3 | 1.0 | 50 | 0.3 | 79.0 | 19.5 |
| 28 | $D_cZED$ | | 80 | 1.81 | 0.45 | 1.3 | 1.0 | 100 | 0.35 | 78.0 | 19.0 |
| 29 | $D_cZED$ | | 80 | 1.81 | 0.45 | 1.0 | 1.0 | 240 | 0.61 | 65.1 | 20.14 |
| 30 | $D_cZED$ | | 80 | 1.81 | 0.45 | 0.5 | 1.0 | 440 | 0.40 | 46.5 | 25.72 |
| 31 | $D_cZED$ | | 20 | 0.45 | 1.81 | 0.5 | 1.0 | 725 | 1.75 | 43.8 | 23.78 |
| 32 | $D_cZED$ | | 20 | 0.45 | 1.81 | 1.1 | 1.0 | 220 | 1.51 | 63.0 | 18.82 |
| 33 | DZED | 0.12 | 100 | 3.88 | 0.00 | 1.1 | 1.0 | 100 | 0.4 | 85.0 | 18.6 |
| 34 | DZED | | 100 | 3.88 | 0.00 | 0.8 | 1.0 | 170 | 0.7 | 79.6 | 21.9 |
| 35 | $D_cZED$ | | 95 | 3.67 | 0.19 | 1.1 | 1.0 | 125 | 0.5 | 85.0 | 18.5 |
| 36 | $D_cZED$ | | 90 | 3.49 | 0.39 | 1.1 | 1.0 | 150 | 0.6 | 84.0 | 18.0 |
| 37 | $D_cZED$ | | 80 | 3.10 | 0.78 | 1.1 | 1.0 | 200 | 0.8 | 83.0 | 17.8 |
| 38 | $D_cZED$ | | 50 | 1.94 | 1.94 | 0.3 | 1.0 | 370 | 2.98 | 72.7 | 18.62 |
| 39 | $D_cZED$ | | 50 | 1.94 | 1.94 | 0.8 | 1.0 | 380 | 2.70 | 72.3 | 18.90 |
| 40 | $D_cZED$ | | 50 | 1.94 | 1.94 | 1.3 | 1.0 | 255 | 2.34 | 84.7 | 15.86 |
| 41 | $D_cZED$ | | 0 | 0.00 | 3.88 | 0.8 | 1.0 | 440 | 4.41 | 67.4 | 17.43 |
| 42 | DZED | 0.17 | 100 | 5.50 | 0.00 | 0.7 | 1.0 | 100 | 0.9 | 87.5 | 20.2 |
| 43 | $D_cZED$ | | 95 | 5.22 | 0.28 | 0.7 | 1.0 | 125 | 1.0 | 87.5 | 20.0 |
| 44 | $D_cZED$ | | 90 | 4.95 | 0.55 | 0.7 | 1.0 | 150 | 1.2 | 87.0 | 19.5 |
| 45 | $D_cZED$ | | 80 | 4.40 | 1.10 | 1.1 | 1.0 | 170 | 2.52 | 88.1 | 15.76 |
| 46 | $D_cZED$ | | 80 | 4.40 | 1.10 | 0.7 | 1.0 | 200 | 1.4 | 86.0 | 19.1 |
| 47 | $D_cZED$ | | 80 | 4.40 | 1.10 | 0.5 | 1.0 | 280 | 3.21 | 84.2 | 21.37 |
| 48 | $D_cZED$ | | 20 | 1.10 | 4.40 | 1.1 | 1.0 | 250 | 6.94 | 86.3 | 14.87 |
| 49 | $D_cZED$ | | 20 | 1.10 | 4.40 | 0.5 | 1.0 | 380 | 5.91 | 76.9 | 19.82 |
| 50 | DZED | 0.20 | 100 | 6.46 | 0.00 | 0.3 | 1.0 | 95 | 1.3 | 88.0 | 25.2 |
| 51 | $D_cZED$ | | 95 | 6.14 | 0.32 | 0.3 | 1.0 | 125 | 1.5 | 88.0 | 24.8 |
| 52 | $D_cZED$ | | 90 | 5.81 | 0.65 | 0.3 | 1.0 | 150 | 1.8 | 87.5 | 24.6 |
| 53 | $D_cZED$ | | 80 | 5.17 | 1.29 | 0.3 | 1.0 | 200 | 2.0 | 87.0 | 24.2 |
| 54 | $D_cZED$ | | 50 | 3.23 | 3.23 | 0.8 | 1.0 | 215 | 5.68 | 88.8 | 15.49 |

(1) Kappa number of 32.2.
(2) Preceded by an alkaline extraction with 3% sodium hydroxide charge.
(3) Based on predicted data, except examples 24, 29–32, 34, 38–41, 45, 47–49 and 54.

Table 5 shows the adsorbed organic halogens (AOX) generated in the bleaching stages of the sequences of Examples 1–3, 9, 11 and 14. Examples 1 and 2 showed AOX levels in excess of the desired 2.0 kg per ton of wood pulp. A pre-delignification stage, as in Example 3, produced effluent within the 2.0 kg level, but Example 3, had high levels of chloride in the wood pulp (see Table 2). Examples 9, 11 and 14 involved stages of chlorine dioxide bleaching followed by ozonation. Example 9 represented a preferred sequence, DZED, and produced effluent well below the targeted AOX level. Example 14 showed that pre-delignification with oxygen can improve the AOX level, but at the expense of the cost associated with the additional stage (O). Notably, the 4-stage DZED (Example 9) sequence produced a lower AOX value than the more costly 6-stage DZEDED (Example 11) sequence.

TABLE 5

| Example | Sequence | AOX (kg/BDT) in effluent Stages | | | | | | Total |
|---|---|---|---|---|---|---|---|---|
| 1 | $D \rightarrow CE_{0+p}D$ | D–C | $E_{o+p}$ | D | | | | 2.20 |
| | | 0.86 | 1.3 | 0.04 | | | | |
| 2 | $D \rightarrow CE_{o+p}DED$ | D–C | $E_{o+p}$ | D | E | D | | 2.23 |
| | | 0.86 | 1.3 | 0.04 | 0.02 | 0.01 | | |
| 3 | $OD \rightarrow CE_{o+p}D$ | D–C | $E_{o+p}$ | D | | | | 1.27 |
| | | 0.71 | 0.5 | 0.06 | | | | |
| 9 | DZED | D | Z | E | D | | | 0.43 |
| | | 0.13 | 0.2 | 0.06 | 0.04 | | | |
| 11 | DZEDED | D | Z | E | D | E | D | 0.63 |
| | | 1.37 | 1.0 | 2.5 | 0.7 | 0.5 | 0.5 | |
| 14 | ODZED | D | Z | E | D | | | 0.32 |
| | | 0.17 | 0.09 | 0.04 | 0.02 | | | |

Figure 4:
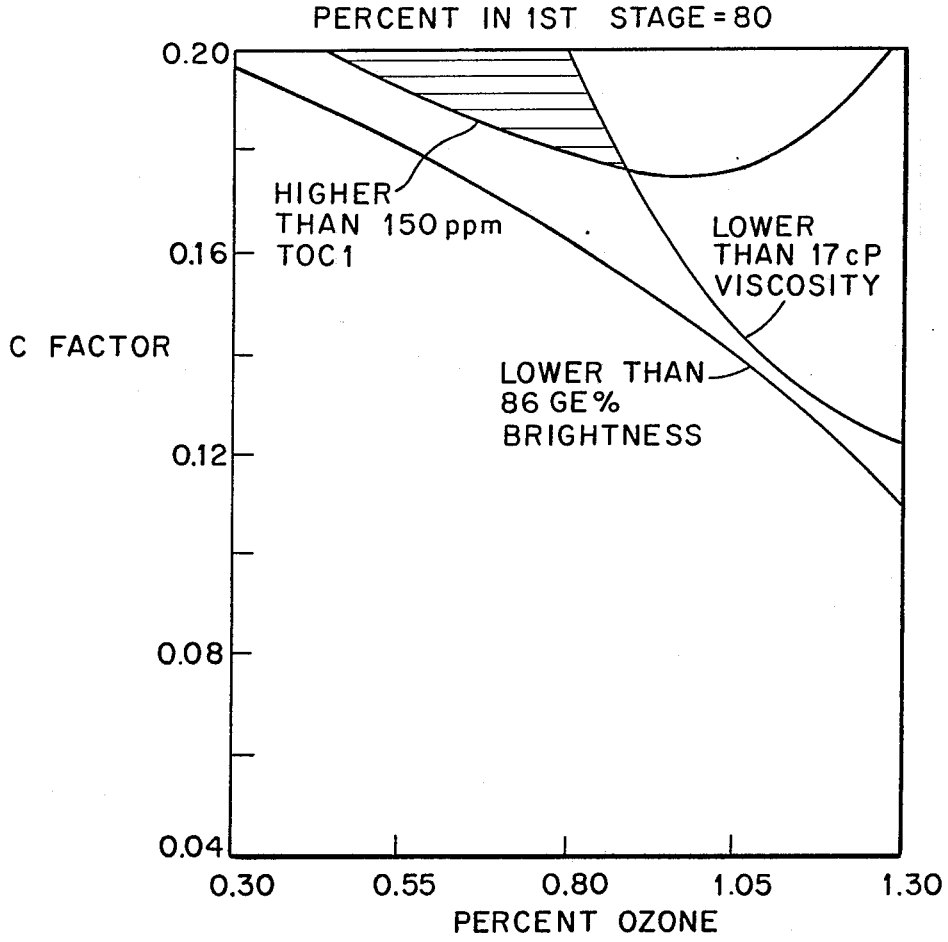
Figure 5:
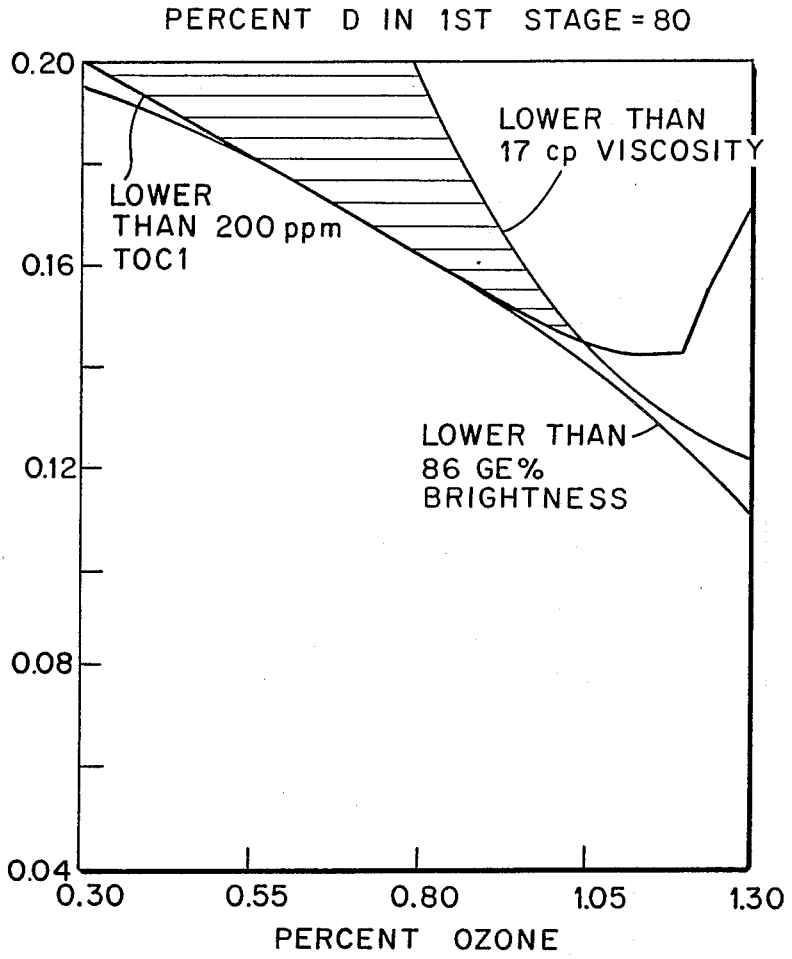

Experimental data were subjected to regression analysis of pulp brightness, viscosity and TOCl on chlorination factor, fraction of chlorine dioxide charge in the $D_c$ stage and ozone charge in the second stage ($D_c$ZED sequence). The results are depicted graphically in FIGS. 1–5. From these Figures, at 100% chlorine dioxide in the $D_c$ stage, it may be seen that as one accepts a lower viscosity, equal amounts of ozone can be employed with lower quantities of chlorine dioxide ("C" factor) while still maintaining high brightness and low TOCl values. This relationship holds true when the chlorine dioxide charge includes up to 20% chlorine (see FIGS. 4 and 5), the actual ranges being somewhat condensed when employing an 80/20 mixture of chlorine dioxide and chlorine.

It may be seen from the foregoing that the present invention provides for a method of preparation of cellulosic wood pulp fibers for use in papermaking that reduces the total chloride residue in the wood pulp to less than 200 ppm and the AOX discharge per ton of wood pulp to less than 2.0 kg. In addition, the wood pulp has a brightness greater than 85% GE and a viscosity above about 14 centipoises. Also, the method is economical and readily adaptable to the current papermaking industry.

From the Examples, it will be noted that the percentage of ozone, based on oven dry weight of pulp, employed varies as a function of the "C" factor, the effective ratio of "C" factor to % ozone being between about 0.11 and 0.6, and preferably between about 0.2 and 0.6 for minimizing the TOCl and AOX values while maximizing the brightness and viscosity values of the pulp.

Various features of the invention which are believed to be novel are set forth in the appended claims.

EXAMPLES 55-56

In Table 6, there are shown the results of two runs in which the dioxin content of the pulp and effluent was determined. Southern pine kraft pulp, with 1% reject from cooking, having a Kappa No. of 30.3 and a viscosity of 35 cP was employed in both examples. In Example 55, a control run indicative of prior art bleaching sequences that do not employ ozone, but which do include oxygen and peroxide enhanced extraction, there was no detectable tetrachlorodibenzodioxin (TCDD). In this example, there was detected 2.5 ppt of tetrachlorodibenzofuran (TCDF). In the effluent from this run there was detected 2.5 ppt and 30.3 ppt of TCDD and TCDF, respectively, In Example 56, a $DZE_oD$ sequence in accordance with the present invention, there were no dioxins (TCDD or TCDF) detected in either the pulp or the effluent.

TABLE 6

DETERMINATION OF DIOXINS

| Example | Bleaching Sequences | Conditions | | | | Brightness (% GE) | AOX (kg/TP) | TOCl (ppm) | Dioxins (unit = ppt) | TCDD | TCDF |
|---|---|---|---|---|---|---|---|---|---|---|---|
| 55 | $D \rightarrow CE_{o+p}D$ | $D \rightarrow C$ | | $E_{o+p}$ | D | 86.5 (81.0) | 2.78 | 210 | Pulp | ND | 2.4 |
| | | 1.53% → 2.67% | | 3% NaOH 0.4% $H_2O_2$ | 0.8% | | | | Effluent | 2.5 | 30.3 |
| 56 | $DZE_oD$ | D | Z | $E_o$ | D | 85.3 (80.0) | 0.49 | 100 | Pulp | ND | ND |
| | | 1.27% | 1.0% | 2% | 0.8% | | | | Effluent | ND | ND |

Remarks:
1. First chlorination stage was conducted at 45° C. for 30 minutes.
2. $E_o$, $E_{o+p}$ was conducted in Quantum Reactor at 10% CSC, 75° C. for 1 hour at 45 psig $O_2$ pressure, gradually reduced to 0 psig.
3. Final D stage was conducted at 10% CSC, 70° C. for 2.5 hours.
4. Not detectable.

EXAMPLE 57

Table 7 presents the results of a bleaching sequence in accordance with the present invention in which the ozonated pulp at a pH of 12.7 was processed directly to an alkaline extraction stage (enhanced with oxygen) without an intervening water washing ($ZE_o$) In this Example 57, the GE brightness of the pulp and its viscosity were lower than when the pulp was washed with water between the Z and E stages, but these parameter values were still in a range that is acceptable for certain pulps. The TOCl of the on pulp was 128 ppm, well below present regulated standards.

TABLE 7

DZED SEQUENCE UNDER ALKALINE OZONATION CONDITIONS

| Example | Sequence | Conditions | | | | Brightness % GE | Viscosity cP | TOCl ppm |
|---|---|---|---|---|---|---|---|---|
| 57 | $D(ZE_o)D$ | D | Z | $E_o$ | D | 81.3 (77.5) | 11 | 128 |
| | | 1.15% | 3% NaOH 34% consistency | 3% | 0.8% | | | |

What is claimed is:

1. A method for the bleaching of cellulosic kraft pulp for use in making a paper comprising a bleaching sequence which includes not more than four stages including chlorine dioxide bleaching as the first stage, ozone bleaching as the second stage, wherein the pulp is passed directly from the chlorine dioxide bleaching stage to the ozone bleaching stage without an intervening extraction stage, an alkaline extraction as the third stage, and chlorine dioxide bleaching as the final stage, said stages being carried out in the order listed, said first stage chlorination being at a chlorination factor of between about 0.04 and about 0.22% based on oven-dried pulp and the quantity of ozone employed in said second stage being between about 0.3% and about 1.1% based on oven-dried pulp, to thereby produce a pulp that contains less than about 200 ppm total organic chlorine and which exhibits a G. E. brightness in excess of about 80%.

2. The method of claim 1 wherein said alkaline extraction stage includes the simultaneous addition of oxygen to the pulp.

3. The method of claim 1 wherein said alkaline extraction stage includes the simultaneous addition of peroxide to the pulp.

4. The method of claim 1 wherein said alkaline extraction stage includes the simultaneous addition of oxygen and peroxide to the pulp.

5. The method of claim 1 wherein said pulp, after treatment, has a viscosity in excess of about 14 centipoises.

6. The method of claim 1 wherein said chlorine dioxide is present in a percentage of between about 100% and 20%.

* * * * *